US009696106B2

(12) United States Patent
Kinmont, Jr.

(10) Patent No.: US 9,696,106 B2
(45) Date of Patent: Jul. 4, 2017

(54) CROSSBOW APPARATUS AND KIT THEREFORE

(71) Applicant: Richard C. Kinmont, Jr., Roy, UT (US)

(72) Inventor: Richard C. Kinmont, Jr., Roy, UT (US)

( * ) Notice: Subject to any disclaimer, the term of this patent is extended or adjusted under 35 U.S.C. 154(b) by 0 days.

(21) Appl. No.: 15/136,798

(22) Filed: Apr. 22, 2016

(65) Prior Publication Data

US 2016/0252320 A1 Sep. 1, 2016

(51) Int. Cl.
*F41B 5/12* (2006.01)
*F41J 1/10* (2006.01)

(52) U.S. Cl.
CPC .. *F41B 5/12* (2013.01); *F41J 1/10* (2013.01)

(58) Field of Classification Search
CPC ..... F41B 3/005; F41B 5/12
See application file for complete search history.

(56) References Cited

U.S. PATENT DOCUMENTS 88,608 A * 4/1869 Carrier ..... F41B 3/005 124/21
1,611,506 A * 12/1926 Bergh ..... F41B 5/12 124/22
2,069,464 A * 2/1937 Umling ..... F41B 5/12 124/25
3,050,046 A * 8/1962 Love ..... F41B 5/12 124/25
3,242,917 A * 3/1966 Benedict ..... F41B 5/12 124/25
3,788,299 A * 1/1974 Mathews ..... F41B 5/12 124/25
5,720,268 A * 2/1998 Koltze ..... F41B 5/0094 124/23.1
7,686,262 B2 * 3/2010 Pierce ..... F41B 5/14 124/25.7
8,033,275 B2 * 10/2011 Bednar ..... F41B 5/123 124/25
8,763,598 B1 * 7/2014 MacLeod ..... F41B 5/1484 124/1
8,991,375 B2 * 3/2015 McPherson ..... F41B 5/123 124/24.1

(Continued)

OTHER PUBLICATIONS

U.S. Appl. No. 29/549,640, filed Dec. 28, 2015, Kinmont.

(Continued)

*Primary Examiner* — John Ricci
(74) *Attorney, Agent, or Firm* — Michael R. Schramm

(57) ABSTRACT

The present invention is a miniature crossbow apparatus expressly adapted for use as a toy or amusement device in launching toy projectiles. The crossbow apparatus may be provided in kit form such that the user may develop construction skills and satisfaction by assembling the crossbow apparatus from provided constituent parts. The crossbow apparatus preferably includes at least one feature of a captive axleless rotating trigger feature, an armed bolt (projectile) retention feature, an integrated spare bolt (projectile) retention feature, a grip comprised of O-rings feature, and a crossbow arm anti-rotation feature. The crossbow apparatus further preferably is provided with a crossbow stand (holder) that doubles a target device.

20 Claims, 6 Drawing Sheets

(56) References Cited

U.S. PATENT DOCUMENTS

2008/0313947 A1* 12/2008 Fachner ..... A01M 31/008
43/1
2010/0224176 A1* 9/2010 Kaylan ..... F41B 5/12
124/25

OTHER PUBLICATIONS

Author = Aviation, Title = Top Mini Crossbow Toy, Date = Unknown, ebay Website.
Author = Full Stainless Steel, Title = Mini crossbow Shooting Targets Toy, Date = Unknown, ebay Website.
Author = Unknown, Title = Sliver XHUNTER Crossbow, Date = Unknown, ebay Website.
Author = Unknown, Title = Beautiful Mini Crossbow, Date = Unknown, ebay Website.
Author = Unknown, Title = World's Smallest Mini Crossbow, Date = Unknown, ebay Website.

* cited by examiner

CROSSBOW APPARATUS AND KIT THEREFORE

FIELD OF THE INVENTION

The present invention relates to toys, and in particular, to toy crossbows for use in developing construction skills and for amusement in launching projectiles.

BACKGROUND OF THE INVENTION

Toy bow and arrow sets are well known in the industry and enjoy widespread use. However, such bow and arrow sets typically require the user to purchase a completed set and most are not of a miniature size. An example of a prior art crossbow apparatus is disclosed in U.S. patent application Ser. No. 29/549,640, which is expressly incorporated herein by reference.

SUMMARY OF THE INVENTION

The present invention is a crossbow apparatus which is preferably a miniature crossbow apparatus expressly adapted for use as a toy or amusement device in launching toy projectiles. The crossbow apparatus may be provided in kit form such that the user may develop construction skills and satisfaction by assembling the crossbow apparatus from provided constituent parts. The body of the crossbow apparatus is preferably constructed of shaped plate members. The crossbow apparatus preferably includes at least one feature of a captive axleless rotating trigger feature, an armed bolt (projectile) retention feature, an integrated spare bolt (projectile) retention feature, a grip comprised of O-rings feature, and a crossbow arm anti-rotation feature. The crossbow apparatus further preferably is provided with a crossbow stand (holder) that doubles a target device.

DESCRIPTION OF DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
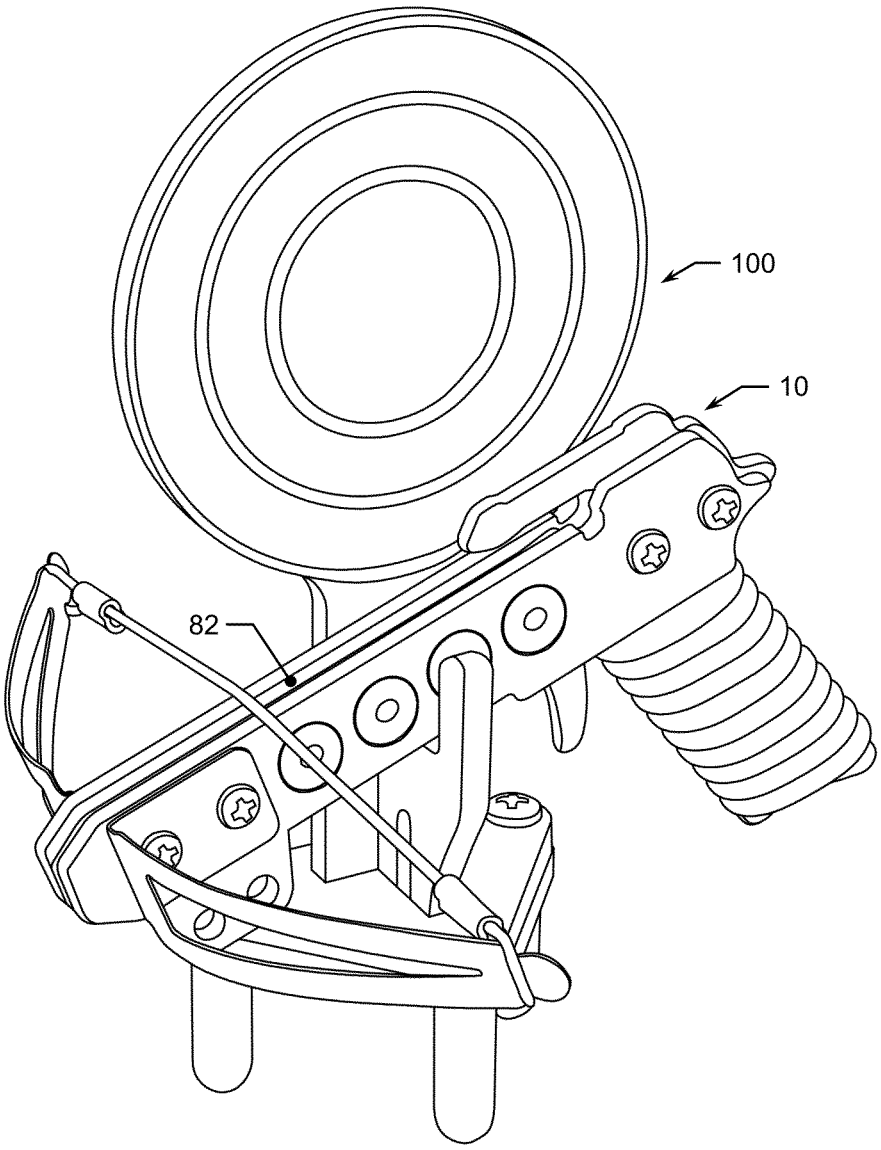
FIG. 1 is a trimetric view of the crossbow apparatus in an assembled, uncocked, and unloaded configuration and resting in the combination stand/target apparatus.
Figure 2:
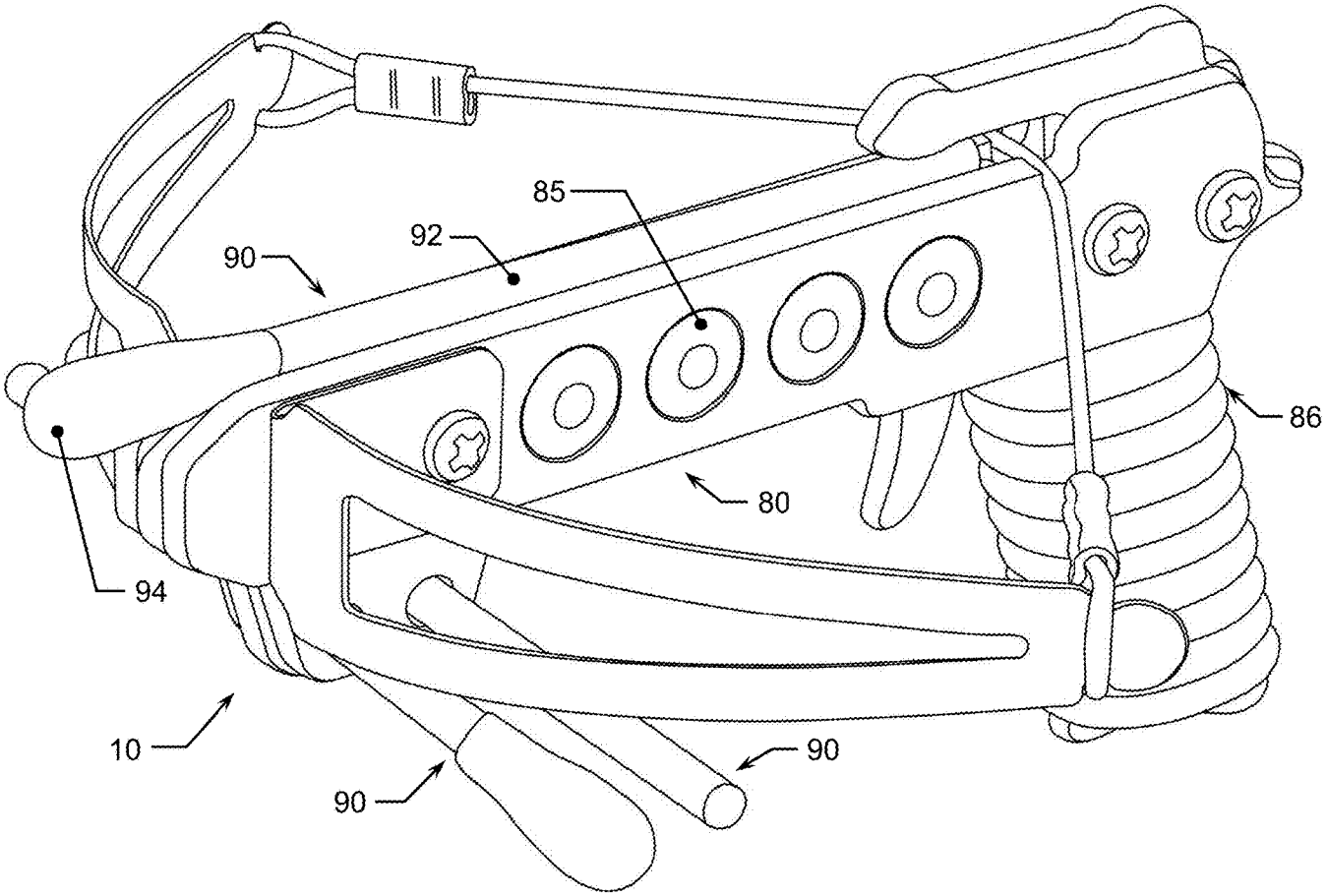
FIG. 2 is a trimetric view of the crossbow apparatus in an assembled, cocked, and loaded configuration.
Figure 3:
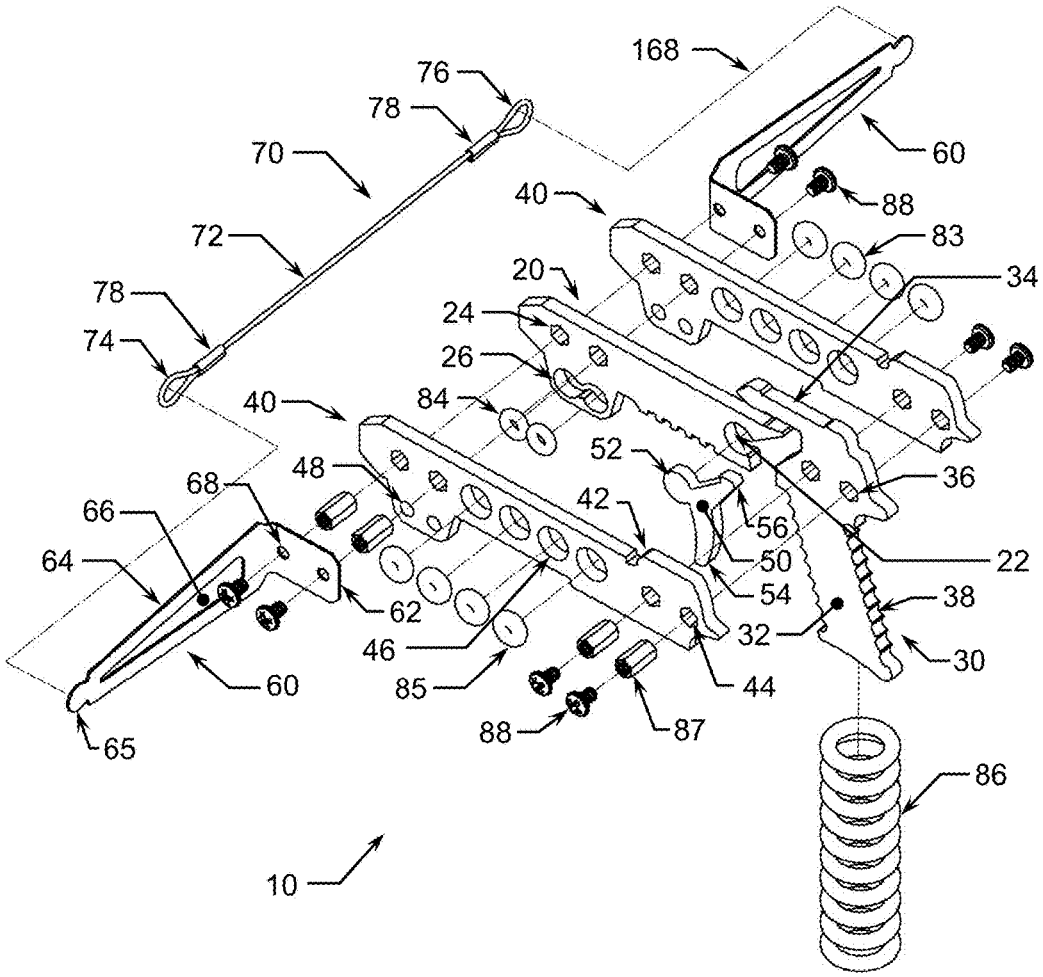
FIG. 3 is an exploded trimetric view of the crossbow apparatus with "explosion lines" shown in phantom lines.
Figure 4:
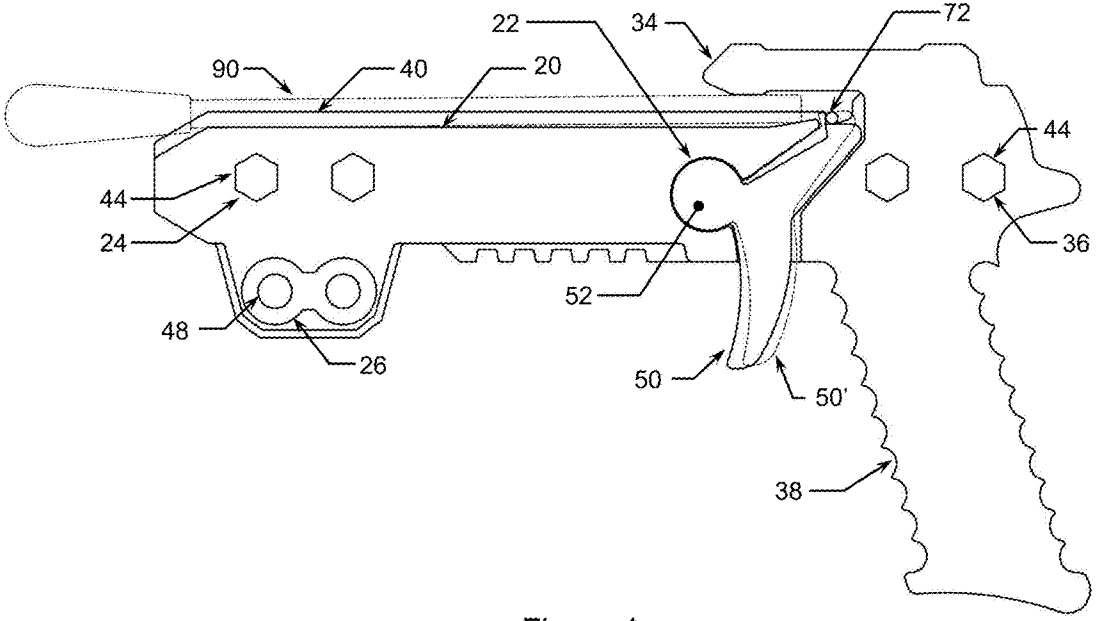
FIG. 4 is an orthographic side sectional view of the crossbow apparatus without crosshatching so as to improve drawing clarity with the bolt shown in phantom lines and with the trigger shown in a pre-actuation position in solid lines and in an actuated position in phantom lines.
Figure 5:
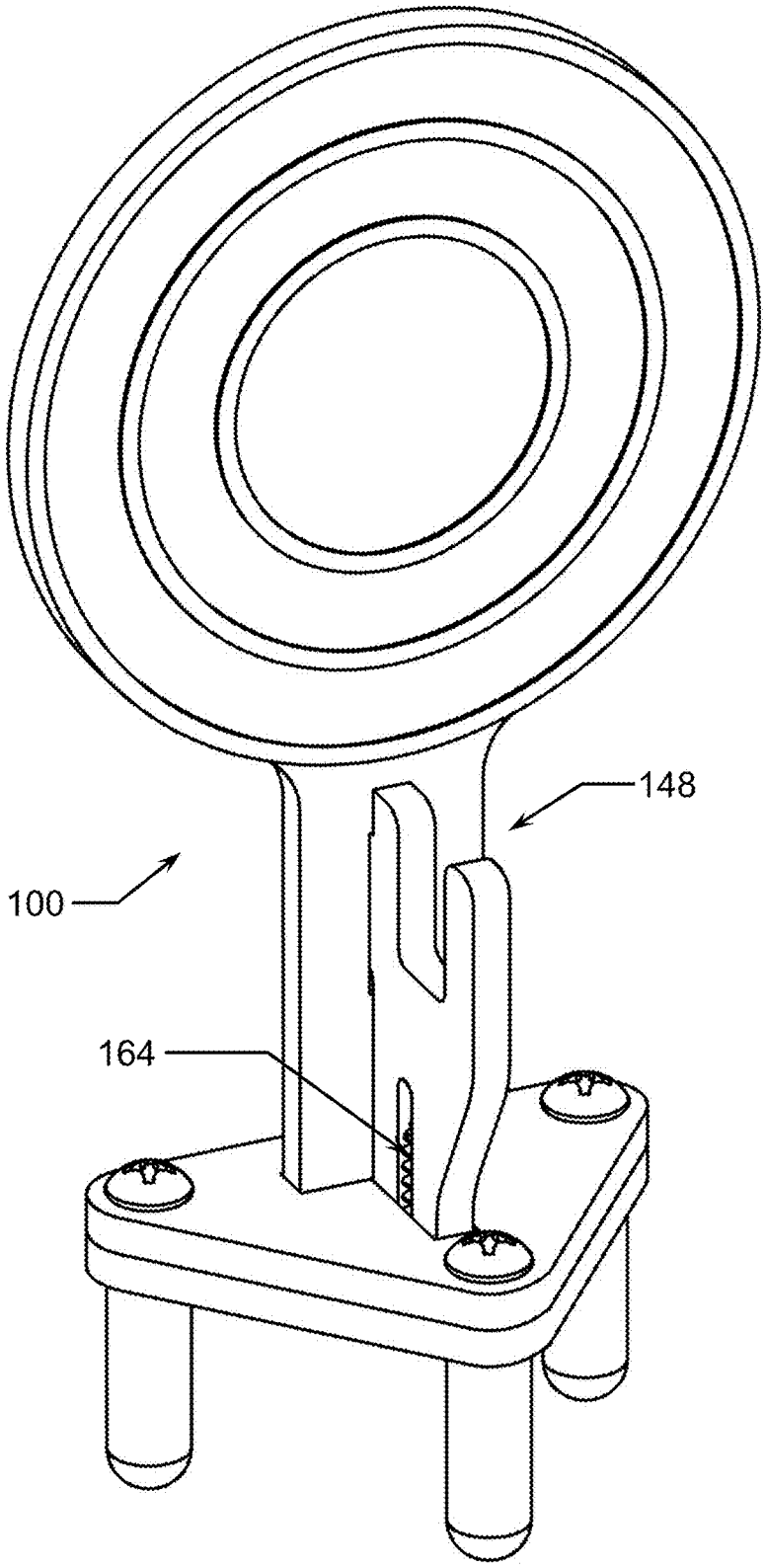
FIG. 5 is a trimetric view of the stand/target apparatus.
Figure 6:
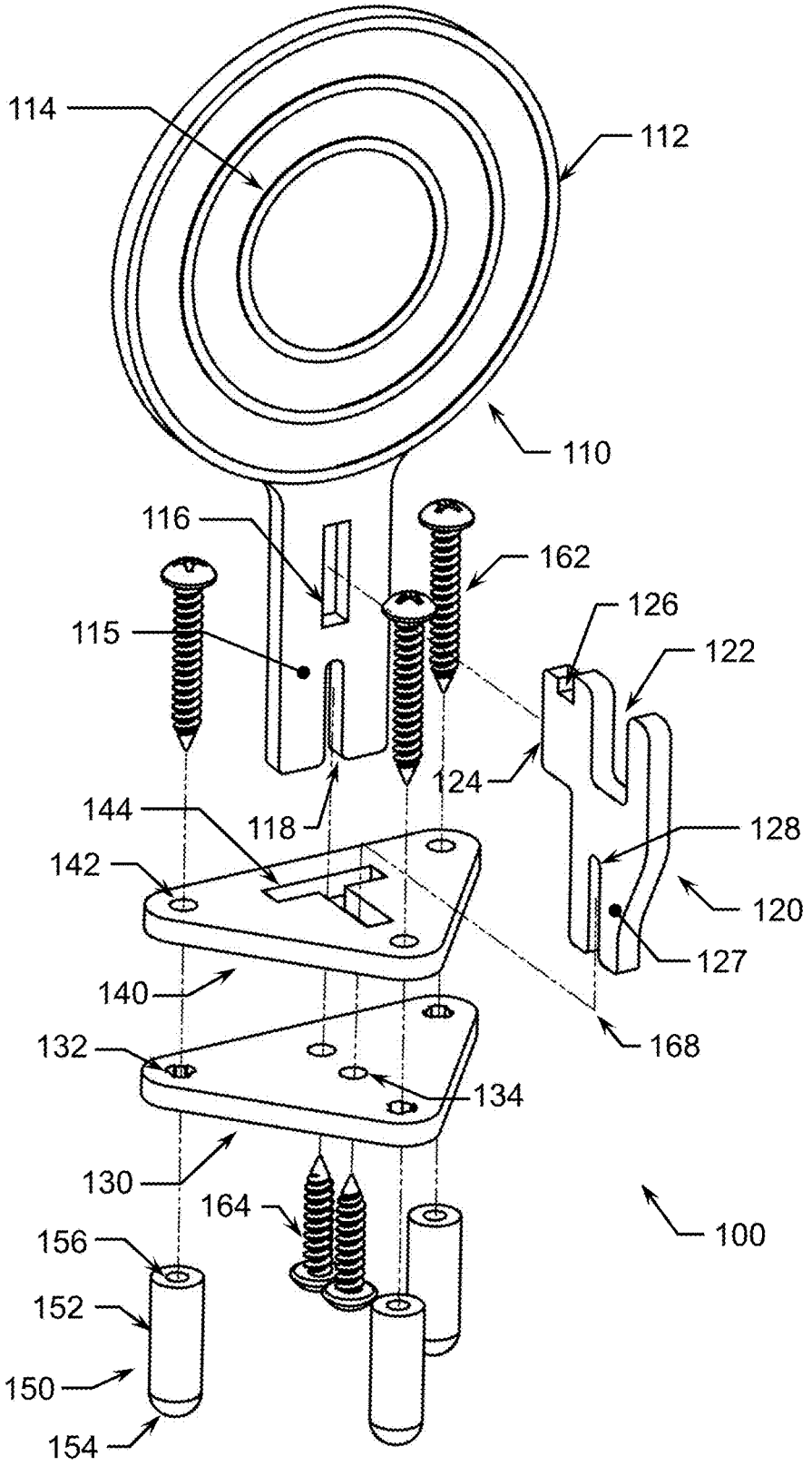
FIG. 6 is an exploded trimetric view of the stand/target apparatus with "explosion lines" shown in phantom lines.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are included to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

In order to facilitate the understanding of the present invention in reviewing the drawings accompanying the specification, a feature table is provided below. It is noted that like features are like numbered throughout all of the figures.

FEATURE TABLE

| # | Feature | # | Feature |
|---|---|---|---|
| 10 | Crossbow apparatus | 20 | Stock base member |
| 22 | Trigger reception hole | 24 | Hexagonal fastener hole |
| 26 | Small O-ring retention hole | 30 | Handle member |
| 32 | Grip | 34 | Bolt retention flange |
| 36 | Hexagonal fastener hole | 38 | Large O-ring retention notch |
| 40 | Stock side member | 42 | Bow string reception notch |
| 44 | Hexagonal fastener hole | 46 | Medium O-ring retention hole |
| 48 | Spare bolt retention hole | 50 | Trigger |
| 52 | Trigger bulb | 54 | Trigger blade |
| 56 | Trigger hammer | 60 | Bow arm device |
| 62 | Attachment flange | 64 | Arm |
| 65 | String attach knob | 66 | Arm opening |
| 68 | Attach hole | 70 | Bow string device |
| 72 | Bow string | 74 | First string loop |
| 76 | Second string loop | 78 | Crimp connectors |
| 80 | Crossbow body | 82 | Channel |
| 84 | Small O-ring | 85 | Medium O-ring |
| 86 | Large O-ring | 87 | Hexagonal fastener insert |
| 88 | Threaded screw | 90 | Bolt |
| 92 | Bolt shaft | 94 | Bolt tip |
| 100 | Stand/target apparatus | 110 | Target device |
| 112 | Target member | 114 | Concentric ring |
| 115 | Flange | 116 | Retention opening |
| 118 | Retention notch | 120 | Cross member |
| 122 | Holder opening | 124 | Upper connection flange |
| 126 | Target retention notch | 127 | Lower connection flange |
| 128 | Base retention notch | 130 | Base plate |
| 132 | Outer fastener hole | 134 | Inner fastener hole |
| 140 | Interface plate | 142 | Outer fastener hole |
| 144 | "T" opening | 148 | Stand/target body |
| 150 | Leg device | 152 | Leg shaft |
| 154 | Foot | 156 | Fastener hole |
| 162 | Long self-tapping screw | 164 | Short self-tapping screw |
| 168 | Explosion line | | |

Referring now to the drawings, in a preferred embodiment the invention is a crossbow apparatus 10 for use as a toy or amusement device in launching toy projectiles and for use in developing construction skills and satisfaction by assembling crossbow apparatus 10 comprising a stock base member 20, a handle member 30, a plurality of stock side members 40, a trigger 50, a plurality of bow arm devices 60, a bow string device 70, a plurality of small O-rings 84, a plurality of medium O-rings 85, a plurality of large O-rings 86, a plurality of hexagonal fastener inserts 87, and a plurality of threaded screws 88.

Stock base member 20 preferably defines a substantially planar stock member of a predetermined profile being preferably cut, routed, punched, or stamped from a sheet such as a sheet of aluminum or steel and having a trigger reception hole 22, a plurality of hexagonal fastener holes 24, and a plurality of small O-ring retention holes 26.

Handle member 30 preferably defines a substantially planar handle member of a predetermined profile being preferably cut, routed, punched, or stamped from a sheet such as a sheet of aluminum or steel and having a grip 32, a bolt retention flange 34, a plurality of hexagonal fastener holes 36, and a plurality of O-ring retention notches 38.

Stock side member 40 preferably defines a substantially planar stock member of a predetermined profile being preferably cut, routed, punched, or stamped from a sheet such as a sheet of aluminum or steel and having a bow string reception notch 42, a plurality of hexagonal fastener holes 44, a plurality of medium O-ring retention holes 46, and a plurality of spare bolt retention holes 48.

Trigger 50 preferably defines a substantially planar trigger of a predetermined profile being preferably cut, routed, punched, or stamped from a sheet such as a sheet of aluminum or steel and having a trigger bulb 52, a trigger blade 54, and a trigger hammer 56.

Bow arm device 60 preferably defines a substantially planar device of a predetermined profile being preferably cut, routed, punched, or stamped from a sheet such as a sheet of spring steel and being bent (such as via a brake press) to further form a substantial "L" shaped device and having an attachment flange 62, an arm 64, a string attach knob 65, an arm opening 66, and a plurality of attach holes 68.

Bow string device 70 defines a bow string device having a bow string 72 and a plurality of crimp connectors 78. Bow string 72 preferably defines a predetermined length of durable string or cord or alternatively, a predetermined length of metal cable. Crimp connector 78 preferably defines a semi-malleable crimpable metal connector. Bow string device 70 is assembled such that a first loop 74 is formed in a first end of string 72 and a crimp connector 78 is crimped onto a portion of loop 74 so as to substantially retain loop 74, and such that a second loop 76 is formed in a second end of string 72 and a crimp connector 78 is crimped onto a portion of loop 76 so as to substantially retain loop 76.

Crossbow apparatus 10 is adapted to be used in combination with bolt 90. Bolt 90 defines an arrow type bolt projectile having a shaft 92 and a preferably blunt tip 94. The exemplary bolt 90 disclosed herein is preferably formed by cutting or otherwise removing one end of a (plastic, wood, rolled paper etc.) stick type cotton swab such as a cotton swab available under the trade name "Q-tips" as supplied by the Unilever Corporation. Bolt 90 may be painted such as with a black or brown paint.

Crossbow apparatus 10 is assembled such that trigger bulb 52 is rotatably positioned in trigger reception hole 22 and one small O-ring 84 is pressed into each of small O-ring retention holes 26. One stock side member 40 is placed on each side of stock base member 20, trigger 50, and handle member 30, such that stock base member 20, trigger 50, and handle member 30 are sandwiched between stock side members 40. One medium O-ring 85 is pressed into each medium O-ring retention hole 46 of each stock side member 40. One hexagonal fastener insert 87 is pressed into each hexagonal fastener hole 44 such that a single hexagonal fastener insert 87 is pressed into a hexagonal fastener hole 44 of a first stock side member 40 and into a hexagonal fastener hole 24 and into a hexagonal fastener hole 44 of a second stock side member 40, and such that a single hexagonal fastener insert 87 is pressed into a hexagonal fastener hole 44 of a first stock side member 40 and into a hexagonal fastener hole 36 and into a hexagonal fastener hole 44 of a second stock side member 40. The combination or "sub-assembly" of stock base member 20, handle member 30, stock side members 40, and a trigger 50 comprise crossbow body 80, thus preferably defining a crossbow body that is substantially entirely comprised of shaped plate members. Crossbow body 80 is also assembled such that channel 82 is formed between stock side members 40 so as to receive bolt 90. Crossbow apparatus 10 is further assembled such that a first bow arm device 60 is mounted to a first stock side member 40 and a second bow arm device 60 is mounted to a second stock side member 40 with threaded screws 88 being inserted through attach holes 68 and threaded into hexagonal fastener inserts 87. Bow string device 70 is mounted to bow arm devices 60 by flexing bow arm devices 60 and placing first sting loop 74 on a first string attach knob 65 and by placing second sting loop 76 on a second string attach knob 65 as is shown in FIG. 1. With bow string device 70 mounted to bow arm devices 60 and in an uncocked configuration, bow arm devices 60 will be flexed somewhat and arms 64 will be somewhat preloaded. Crossbow apparatus 10 is further assembled such that large O-rings 86 are stretched onto large O-ring retention notches 38 to provide a more sure grippable surface of grip 32. It shall be noted that crossbow apparatus 10 preferably defines a miniature Crossbow apparatus which for the purposes of this application shall be defined as a crossbow apparatus that fits within a 12 inch×12 inch×12 inch cubic three dimensional spatial envelope. In a preferred embodiment, crossbow apparatus 10 disclosed herein fits within a 6 inch×6 inch×6 inch cubic three dimensional spatial envelope. It shall also be noted that phantom lines 168 are "explosion lines" and indicated the assembly relationship between the various components.

With crossbow apparatus 10 thus assembled, crossbow apparatus 10 is used by cocking crossbow apparatus 10 by pulling bow string 72 towards handle member 30 and causing bow string 72 to rest in bow string reception notch 42. Crossbow apparatus 10 is armed by loading a bolt 90 into channel 82 such that bolt 90 is actuatingly but retentatively placed held in place between channel 82 and bolt retention flange 34. Once cocked and armed, crossbow apparatus 10 is fired or actuated by pulling trigger blade 54 such that trigger 50 rotates about trigger bulb 52 and such that trigger hammer 56 pushes bow string 72 out of bow string reception notch 42. The released of bow string 72 out of bow string reception notch 42 causes bow string 72 to snap forward and to engage and propel bolt 90 as a projectile towards an intended target. Crossbow apparatus 10 is also adapted such that spare bolts 90 may be stored in crossbow apparatus 10 by inserting spare bolts 90 through spare bolt retention holes 48 and small O-ring retention holes 26 such that spare bolts 90 are removeably held in place by small O-rings 84.

Crossbow apparatus 10 is preferably used in combination with stand/target apparatus 100. Referring again to the drawings, in a preferred embodiment the stand/target apparatus 100 is used as a combined crossbow display stand (holder) and target comprising a target device 110, a cross member 120, a base plate 130, an interface place 140, a plurality of leg devices 150, a plurality of long self-tapping screws 162, and a plurality of short self-tapping screws 164.

Target device 110 preferably defines a substantially planar target device of a predetermined profile being preferably cut, routed, punched, or stamped from a sheet such as a sheet of aluminum or steel and having a target member 112, concentric rings 114, a flange 115, a retention opening 116, and a retention notch 118.

Cross member 120 preferably defines a substantially planar cross member of a predetermined profile being preferably cut, routed, punched, or stamped from a sheet such as a sheet of aluminum or steel and having a holder opening 122, an upper connection flange 124, a target retention notch 126, a lower connection flange 127, and a base retention notch 128.

Base plate 130 preferably defines a substantially planar base plate of a predetermined profile being preferably cut, routed, punched, or stamped from a sheet such as a sheet of aluminum or steel and having a plurality of outer fastener holes 132 and a plurality of inner fastener holes 134.

Interface plate 140 preferably defines a substantially planar interface plate of a predetermined profile being preferably cut, routed, punched, or stamped from a sheet such as a sheet of aluminum or steel and having a plurality of outer fastener holes 14 and a "T" (shaped) opening 144.

Leg device 150 comprises leg shaft 152 having a foot 154 connected on a first end and a fastener hole 156 positioned in a second end. Leg shaft 152 and foot 154 are may be comprised of metal, wood, plastic, or other suitable material.

Stand/target apparatus 100 is assembled such that upper connection flange 124 is inserted into retention opening 116 with flange 115 position into target retention notch 126. Interface plate 140 is positioned onto target device 110 and cross member 120 such that flange 115 and lower connection flange 127 are positioned within "T" opening 144. Base plate 130 is positioned in faying contact with a lower surface of interface plated 140, and short self-tapping screws 164 are threaded through inner fastener holes 134 such that one short self-tapping screw 164 each is threaded into base retention notch 128 and retention notch 118 such that target device 110, cross member 120, base plate 130, and interface place 140 are securely connected together. The combination or "sub-assembly" of target device 110, cross member 120, base plate 130, and interface place 140 comprise stand/target body 148, thus preferably defining a stand/target body that is substantially entirely comprised of shaped plate members. Stand/target apparatus 100 is further assembled such that leg devices 150 are positioned on a lower side of base plate 130 and such that long self-tapping screws 162 are threaded through outer fastener holes 142, outer fastener holes 132, and into fastener holes 156 such that leg devices 150 are secured to stand/target body 148.

With stand/target apparatus 100 thus assembled, stand/target apparatus 100 is used by shooting bolts 90 preferably at concentric target rings 114. When crossbow apparatus 10 is not in use, stand/target apparatus 100 is also used by placing crossbow apparatus 10 in holder opening 122 preferably such that at least one set of medium O-rings 85 are press-fit within holder opening 122 and such that crossbow apparatus 10 is displayed.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A crossbow apparatus having a body and a slidingly rotatable captive axleless trigger device, wherein sliding rotation of said captive axleless trigger device causes said crossbow apparatus to fire.

2. The crossbow apparatus of claim 1, wherein said crossbow apparatus defines a miniature toy crossbow apparatus and fits within at least one cubic three dimensional spatial envelope of a 12 inch×12 inch×12 inch cubic three dimensional spatial envelope and a 6 inch×6 inch×6 inch cubic three dimensional spatial envelope.

3. The crossbow apparatus of claim 1, wherein said crossbow apparatus includes at least one of an armed bolt retention device, a spare bolt retention device, and a body substantially comprising a plurality of joined shaped planar members.

4. The crossbow apparatus of claim 1, wherein said crossbow body includes at least one substantially planar base member and a plurality of substantially planar side members, and wherein said crossbow apparatus is constructed such that said at least one base member is sandwiched between said plurality of side members.

5. The crossbow apparatus of claim 4, wherein said crossbow apparatus includes a substantially planar trigger member having a substantially circular shaped bulb, and wherein said base member includes a substantially circular shaped opening formed therein adapted to receive said bulb, and wherein said crossbow apparatus is constructed such that said trigger member bulb is positioned within said circular shaped opening and is sandwiched between said plurality of side members such that said trigger member is actuatable by slidingly rotating said trigger member about said bulb.

6. The crossbow apparatus of claim 1, wherein said crossbow body defines a plurality of joined shaped planar members constructed of at least one of aluminum sheet and steel sheet.

7. The crossbow apparatus of claim 1, wherein said crossbow apparatus includes at least one of a handle having a grip formed of O-rings stretched over said handle and a bolt loaded in said crossbow apparatus wherein said bolt defines a cotton swab with one end thereof removed.

8. The crossbow apparatus of claim 1, wherein said crossbow apparatus is removably and displayably mounted on a stand.

9. The crossbow apparatus of claim 8, wherein said stand defines a combination display stand and target.

10. A miniature toy crossbow apparatus having a body and a slidingly rotatable captive axleless trigger device, wherein sliding rotation of said captive axleless trigger device causes said crossbow apparatus to fire, and wherein the axis of rotation of said sliding rotation of said captive axleless trigger passes through said captive axleless trigger, and wherein said crossbow apparatus fits within at least one cubic three dimensional spatial envelope of a 12 inch×12 inch×12 inch cubic three dimensional spatial envelope and a 6 inch×6 inch×6 inch cubic three dimensional spatial envelope.

11. The crossbow apparatus of claim 10, wherein said crossbow apparatus includes at least one of an armed bolt retention device, a spare bolt retention device, and a body substantially comprising a plurality of joined shaped planar members.

12. The crossbow apparatus of claim 10, wherein said crossbow body includes at least one substantially planar base member and a plurality of substantially planar side members, and wherein said crossbow apparatus is constructed such that said base member is sandwiched between said plurality of side members.

13. The crossbow apparatus of claim 12, wherein said crossbow apparatus includes a substantially planar trigger member having a substantially circular shaped bulb, and wherein said base member includes a substantially circular shaped opening formed therein adapted to receive said bulb, and wherein said crossbow apparatus is constructed such that said trigger member bulb is positioned within said circular shaped opening and is sandwiched between said plurality of side members such that said trigger member is actuatable by slidingly rotating said trigger member about said bulb.

14. The crossbow apparatus of claim 10, wherein said crossbow apparatus includes at least one of a handle having a grip formed of O-rings stretched over said handle and a bolt loaded in said crossbow apparatus wherein said bolt defines a cotton swab with one end thereof removed.

15. The crossbow apparatus of claim 10, wherein said crossbow apparatus is removably and displayably mounted on a stand.

16. The crossbow apparatus of claim 15, wherein said stand defines a combination display stand and target.

17. A crossbow apparatus kit having a plurality of constituent components expressly adapted to be assembled so as to construct a crossbow apparatus having a body and a slidingly rotatable captive axleless trigger device adapted such that sliding rotation of said captive axleless trigger device will cause said crossbow apparatus to fire.

18. The kit of claim 17, wherein said constituent components include at least one substantially planar base member, a plurality of substantially planar side members, and a substantially planar trigger member.

19. The kit of claim 18, wherein said constituent components further includes at least one of a plurality of O-rings, a combination display stand and target, and a bolt defining a cotton swab with one end thereof removed.

20. The kit of claim 17, wherein said kit is expressly adapted such that said constituent components may be assembled to form a crossbow apparatus having at least one substantially planar base member sandwiched between a plurality of substantially planar side members, and having a substantially planar trigger member captively positioned within an opening of said at least one base member such that said trigger member may be slidingly rotatingly actuated within said base member.

* * * * *